US005643659A

United States Patent [19]

Kobayashi et al.

[11] Patent Number: 5,643,659

[45] Date of Patent: Jul. 1, 1997

[54] HEAT TRANSFER PRINTING SHEET FOR PRODUCING IMAGES HAVING METALLIC LUSTER

[75] Inventors: Shuji Kobayashi; Keiichi Ogawa, both of Tokyo-To, Japan

[73] Assignee: Dai Nippon Printing Co., Ltd., Japan

[21] Appl. No.: 452,790

[22] Filed: May 30, 1995

[30] Foreign Application Priority Data

May 30, 1994 [JP] Japan ..... 6-139469

[51] Int. Cl.[6] ..... B41M 5/26; B41M 5/34

[52] U.S. Cl. ..... 428/216; 428/195; 428/206; 428/207; 428/328; 428/480; 428/484; 428/488.1; 428/488.4; 428/913; 428/914

[58] Field of Search ..... 428/195, 206, 428/207, 212, 913, 914, 484, 488.1, 488.4, 215, 216, 328, 336, 480

[56] References Cited

U.S. PATENT DOCUMENTS 4,472,479 9/1984 Hayes et al. ..... 428/324

FOREIGN PATENT DOCUMENTS 2198254 6/1988 United Kingdom ..... 428/212

OTHER PUBLICATIONS

Patent Abstracts of Japan, vol. 13, No. 118 (M-806), Mar. 1989.

Patent Abstracts of Japan, vol. 7, No. 177 (M-233), Aug. 1983.

*Primary Examiner*—Bruce H. Hess
*Attorney, Agent, or Firm*—Parkhurst, Wendel & Burr, L.L.P.

[57] ABSTRACT

A heat transfer printing sheet for producing images having metallic luster, obtained by successively providing, at least on one surface of a substrate sheet, a transparent coloring layer comprising a coloring agent and a hot-melt binder, and a metallic ink layer comprising a metallic pigment and a hot-melt binder. This printing sheet can be obtained without using a specific apparatus such as a sputtering apparatus, does not require an adhesive layer, and can produce a highly-bright colored image having metallic luster.

4 Claims, 1 Drawing Sheet

HEAT TRANSFER PRINTING SHEET FOR PRODUCING IMAGES HAVING METALLIC LUSTER

BACKGROUND OF THE INVENTION

The present invention relates to a heat transfer printing sheet for use with a heat transfer printer having a heating means such as a thermal head or a laser. More specifically, the present invention relates to a heat transfer printing sheet which can easily produce images having metallic luster when it is used with a heat transfer printer.

Heretofore, the melt transfer printing method has been known. In this method, a heat transfer printing sheet which comprises a substrate sheet such as a plastic film, and a hot-melt ink layer provided thereon, containing a coloring material such as a pigment which is dispersed in a binder such as a hot- melt wax or resin is used; energy is applied image-wise to a heating device such as a thermal head to heat the heat transfer printing sheet, thereby transferring, along with the binder, the coloring material to an image-receiving sheet such as paper or a plastic sheet to produce an image thereon. The image produced by the melt transfer printing method has high density and is excellent in sharpness. The printing method of this type is thus suitable to record binary images such as letters and line images. Further, it is also possible to obtain a multi- or full-colored image on an image-receiving sheet by recording yellow, magenta, cyan and black images one over another by the use of heat transfer printing sheets of these colors.

A demand for easy and simple production of images having metallic luster by utilizing the melt transfer printing method has also been increased. Japanese Laid-Open Patent Publication No. 30288/1988 and the like present a heat transfer recording medium obtained by successively providing, on one surface of a substrate, a releasing layer, a deposited anchor layer, a metal-deposited layer and an adhesive layer. Aside from this, Japanese Laid-Open Patent Publication No. 290789/1988 and the like present a heat-sensitive transfer printing material obtained by providing, on a substrate, an ink layer containing a metal powder pigment and a colorant which are dispersed in a hot-melt vehicle.

In the case where a metal-deposited layer is provided, an image having high brightness, being excellent in visibility can be obtained. In this case, however, a specific apparatus such as a sputtering apparatus is needed to form the deposited layer. Moreover, the deposited layer has no adhesive property in itself, so that it is necessary to provide an adhesive layer as in the prior art. Therefore, there has been a problem in that the production process becomes complicated as a whole.

Furthermore, in the case where an ink layer in which a metallic pigment and a colorant are dispersed is provided, the colorant such as a pigment or a dye and the metallic pigment tend to separate from each other when a coating liquid for forming the ink layer is prepared, so that it is difficult to stably coat the coating liquid onto a substrate. For this reason, the metallic pigment cannot be coated uniformly, and the resulting printing sheet cannot produce an image having high brightness.

DISCLOSURE OF THE INVENTION

An object of the present invention is to solve the aforementioned problems in the prior art, thereby providing a heat transfer printing sheet which can be obtained without using a specific apparatus such as a sputtering apparatus, which requires no adhesive layer, and which can produce a colored image having highly-bright metallic luster.

The present invention is a heat transfer printing sheet for producing images having metallic luster, comprising a substrate sheet, a transparent coloring layer comprising a coloring agent and a hot-melt binder, provided at least on one surface of the substrate sheet, and a metallic ink layer comprising a metallic pigment and a hot-melt binder, provided on the transparent coloring layer.

Further, the present invention is a heat transfer printing sheet for producing images having metallic luster, further comprising a releasing layer between the substrate sheet and the transparent coloring layer.

Furthermore, the present invention is a heat transfer printing sheet for producing images having metallic luster, in which the metallic pigment has a particle diameter of 1 to 20 micrometers.

In the present invention, a transparent coloring layer comprising a coloring agent, and a metallic ink layer comprising a metallic pigment are provided separately. Therefore, the coloring agent and the metallic pigment are free from separation which tends to impair the brightness of a printed image due to the reason mentioned previously. A colored image having metallic luster can thus be obtained easily. Further, the metallic ink layer can be formed by coating an ink which is similar to a printing ink, so that it is not necessary to use a sputtering apparatus or the like. Furthermore, the ink itself has adhesive property, so that there is no need to provide an adhesive layer which is required when a metal-deposited layer is provided.

BEST MODE FOR CARRYING OUT THE INVENTION

Figure 1:
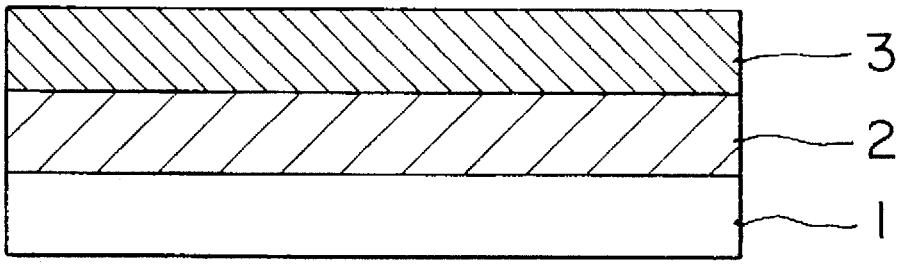
FIG. 1 is a cross-sectional view of a heat transfer printing sheet for producing images having metallic luster according to the present invention.

FIG. 1 is a cross-sectional view of a heat transfer printing sheet for producing images having metallic luster according to the present invention, in which reference numeral 1 denotes a substrate sheet, reference numeral 2 denotes a transparent coloring layer, and reference numeral 3 denotes a metallic ink layer.

Any substrate sheet used for the conventional heat transfer printing sheets can be used as it is as the substrate sheet 1. Specifically, a polyester film, condenser paper or the like can be used. The thickness of the substrate sheet can be selected depending upon the material used so that the strength and thermal conductivity of the substrate sheet will be proper. However, a preferable thickness is from 2 to 25 micrometers. On the surface of the substrate sheet opposite to the surface on which the transfer layers are provided, it is also possible to provide a heat-resistant slippery layer in order to prevent the thermal fusion of the substrate sheet and a thermal head, and to improve slipperiness.

The transparent coloring layer 2 comprises a binder which is a resin, a wax or a mixture thereof, and a coloring agent such as a dye or a pigment.

Examples of the resin used as the binder include polyolefin resins such as ethylene-vinyl acetate copolymer and ethylene-acrylic acid copolymer, polyamide resins, polyester resins, epoxy resins, polyurethane resins, acrylic resins, polyvinyl chloride resins, polyvinyl acetate resins, petroleum resins, phenolic resins and polystyrene resins.

Examples of the wax used as the binder include a variety of waxes such as microcrystalline wax, carnauba wax, paraffin wax, Fischer-Tropsch wax, various low-molecular-weight polyethylenes, Japan wax, beeswax, spermaceti, insect wax, wool wax, shellac wax, candelilla wax, petrolatum, partially- modified waxes, fatty esters and fatty amides.

Coloring agents such as conventionally-known dyes and pigments can be used either singly or in combination of any of them as the coloring agent.

Specific examples of the coloring agent include carbon black, nigrosine dye, lamp black, Sudan Black SM, Alkali Blue, Fast Yellow G, Benzidine Yellow, Pigment Yellow, Indofast Orange, Irgazin Red, Paranitroaniline Red, Toluidine Red, Carmine FB, Permanent Bordeaux FRR, Pigment Orange R, Lithol Red 20, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y 963, Kayaset YG, Sumiblast Yellow GG, Zapon Fast Orange RR, Oil Scarlet, Sumiblast Orange G, Orasol Brown B, Zapon Fast Scarlet CG, Aizen Spiron Red BEH, Oil Pink OP, Victoria Blue F4R, Fastogen Blue 5007, Sudan Blue and Oil Peacock Blue.

The amount of the coloring agent to be incorporated into the coloring layer can be selected freely in consideration of the following: the coloring layer does not completely hide the metallic ink layer which comes under the coloring layer after these layers are transferred to an image-receiving sheet, and the coloring layer does not impair the brightness of an image printed. It is however preferable to incorporate 5 to 100 parts by weight of the coloring agent for 100 parts by weight of the binder.

The thickness of the coloring layer can be freely selected in consideration of printing sensitivity. However, a preferable thickness is 3 micrometers or less. When the thickness of the coloring layer becomes more than 3 micrometers, transfer printing sensitivity is lowered, and, as a result, a high-quality image cannot be obtained.

The metallic ink layer 3 comprises a binder which is a resin, a wax or a mixture thereof, and a metallic pigment which is a powder of a metal such as gold, silver, copper, aluminum or chromium, or of an alloy thereof.

Examples of the resin used as the binder include polyolefin resins such as ethylene-vinyl acetate copolymer and ethylene-acrylic acid copolymer, polyamide resins, polyester resins, epoxy resins, polyurethane resins, acrylic resins, polyvinyl chloride resins, polyvinyl acetate resins, petroleum resins, phenolic resins and polystyrene resins.

Examples of the wax used as the binder include a variety of waxes such as microcrystalline wax, carnauba wax, paraffin wax, Fischer-Tropsch wax, various low-molecular-weight polyethylenes, Japan wax, beeswax, spermaceti, insect wax, wool wax, shellac wax, candelilla wax, petrolatum, partially- modified waxes, fatty esters and fatty amides.

Examples of the metallic pigment include powders of metals such as gold, silver, copper, aluminum and chrominum, and of alloys thereof. These powders can be used either singly or in combination of any of them. Of these metallic pigments, aluminum powder is preferable from the viewpoints of gloss and cost.

The particle diameter and the amount of the metallic pigment can be freely selected in consideration of the hiding power and brightness of an image printed, and transfer printing sensitivity.

When a metallic pigment having a larger particle diameter is used, an image having higher brightness can be obtained. However, the hiding power of the image is lowered, so that the color of the image-receiving sheet can be identified through the image. In addition, higher printing energy is needed when printing is conducted. On the contrary, when the metallic pigment has a smaller particle diameter, an image can be printed with lower printing energy, and it has higher hiding power. There is however a problem in that the image printed is poor in brightness. Therefore, the mean particle diameter of the metallic pigment (determined by a laser method) is preferably from 1 to 20 micrometers, particularly from 1 to 10 micrometers. When the mean particle diameter of the metallic pigment is less than 1 micrometer, an image printed is poor in brightness. On the other hand, when the mean particle diameter is in excess of 20 micrometers, the metallic ink layer is poor in transferability, and an image printed has lower hiding power.

The amount of the metallic pigment incorporated into the metallic ink layer is preferably from 10 to 400 parts by weight, particularly from 20 to 300 parts by weight for 100 parts by weight of the binder. When the amount of the metallic pigment is less than 10 parts by weight, an image obtained is poor in hiding power. On the other hand, when more than 400 parts by weight of the metallic pigment is incorporated, an image cannot be fully fixed on an image-receiving sheet when printing is conducted.

Further, additives such as a dispersant and an anti-settling agent may also be added to the metallic ink layer, if necessary. By the addition of these additives, the dispersibility of the metallic pigment in the metallic ink layer is improved. The brightness of an image printed can thus be effectively improved.

The thickness of the metallic ink layer can be freely selected in consideration of hiding power and transfer printing sensitivity. However, a preferable thickness is from 0.1 to 3 micrometers. When the thickness of the metallic ink layer is less than 0.1 micrometers, an image obtained is poor in hiding power. On the other hand, when the thickness becomes more than 3 micrometers, transfer printing sensitivity is lowered. A releasing layer can be provided between the substrate sheet and the transparent coloring layer, if necessary. For example, acrylic resin, silicone resin, fluororesin, and various silicone- or fluorine-modified resins, which are excellent in releasability, can be used for the releasing layer. However, a variety of waxes which are melted when printing is conducted to show releasability are particularly preferable. Examples of the wax which can be suitably used include a variety of waxes such as microcrystalline wax, carnauba wax, paraffin wax, Fischer-Tropsch wax, various low- molecular-weight polyethylenes, Japan wax, beeswax, spermaceti, insect wax, wool wax, shellac wax, candelilla wax, petrolatum, partially-modified waxes, fatty esters and fatty amides. It is necessary to make the above releasing layer thin so as not to impair the sensitivity of the resulting heat transfer printing sheet; a preferable thickness of the releasing layer is approximately 0.1 to 2 micrometers. By providing such a releasing layer, transfer printing can be conducted with low printing energy. Further, the releasing layer is transferred by being separated, at the interface thereof, from the substrate sheet, or by being broken, thereby imparting slipperiness to the outermost surface of an image printed. It is therefore preferable to form the releasing layer by the use of a material which has hardness to some degree as well as slipperiness, for example, a material having a penetration at 20° to 40° C. of 10 or less.

A protective layer can be provided, when necessary, between the substrate sheet and the transparent coloring layer, or between the releasing layer and the transparent coloring layer. The protective layer is transferred along with the transparent coloring layer and the metallic ink layer when heat transfer printing is conducted, thereby covering the surface of an image printed. The protective layer is provided by using a resin capable of forming a film which is excellent in heat resistance and abrasion resistance, such as acrylic resin, polyurethane resin, a copolymer of acrylic monomer and other monomer, polyester resin or polyamide resin. However, a film formed by using such a resin is not clearly cut when printing is conducted. It is therefore desirable to make the protective layer thin so that it can be cut clearly; a thickness of the protective layer is, for example, approximately 0.1 to 1.5 micrometers. It is preferable to incorporate a fine extender pigment such as silica, alumina, clay or calcium carbonate into the protective layer so that the protective layer can be cut more clearly.

In the case where the protective layer itself is highly releasable from the substrate sheet, it can also serve as a releasing layer. Therefore, a heat transfer printing sheet may be obtained by successively providing, on the substrate sheet, the protective layer, the transparent coloring layer and the metallic ink layer. When the protective layer is insufficient in releasability, a heat transfer printing sheet may be obtained by successively providing, on the substrate sheet, the releasing layer, the protective layer, the transparent coloring layer and the metallic ink layer.

It is preferable to incorporate a tacky resin such as rubber resin or ethylene-vinyl acetate copolymer into the transparent coloring layer, the releasing layer or the protective layer which is directly provided on the substrate sheet in such an amount that does not mar the transferability of the layer. When such a tacky resin is added to the layer in a suitable amount, the layer is prevented from falling off the substrate sheet when transfer printing is not conducted. Various means such as hot-melt coating, hot lacquer coating, gravure coating, gravure reverse coating, roll coating and emulsion coating can be mentioned as means to form the above-described transparent coloring layer, metallic ink layer, releasing layer and protective layer. However, it is not suitable to use an aqueous ink to form the metallic ink layer because water reacts with the metallic pigment to produce hydrogen. It is therefore preferable to use a solvent-type ink or a hot-melt ink to form the metallic ink layer.

The present invention will now be explained more specifically by referring to the following Examples and Comparative Examples. Throughout these examples, amounts expressed in "parts" or "%" are based on weight, unless otherwise indicated.

EXAMPLE 1

1.0 g/m$^2$ (dry basis) of the following ink composition was coated, by a bar coater, onto the surface of a polyester film ("Lumirror" manufactured by Toray Industries, Inc.) having a thickness of 6.0 micrometers, provided with a heat-resistant slippery layer on the back surface thereof, and then dried at 80° C. to form a transparent coloring layer.

<Ink Composition for Forming Transparent Coloring Layer>

"Hakurinisu 45 Yellow" (manufactured by Showa Ink Kogyosho K.K., methylmethacrylate varnish+yellow dye)

0.5 g/m$^2$ (dry basis) of the following ink composition was coated onto the surface of the above transparent coloring layer by a bar coater, and then dried at 80° C. to form a metallic ink layer. Thus, a heat transfer printing sheet for producing images having metallic luster according to the present invention was obtained.

<Ink Composition for Forming Metallic Ink Layer>

| | |
|---|---|
| Aluminum paste (manufactured by Showa Aluminum Powder K.K., mean particle diameter = 6 micrometers) | 37.0 parts |
| "Vylon 200" (manufactured by Toyobo Co., Ltd., polyester) | 10.0 parts |
| MEK | 41.0 parts |
| Toluene | 41.0 parts |

EXAMPLE 2

The procedure of Example 1 was repeated except that the aluminum paste used in Example 1 was replaced by an aluminun paste (manufactured by Showa Aluminum Powder K.K.) having a mean particle diameter of 13 micrometers, whereby a heat transfer printing sheet for producing images having metallic luster according to the present invention was obtained.

EXAMPLE 3

The procedure of Example 1 was repeated except that the aluminum paste used in Example 1 was replaced by an aluminun paste (manufactured by Showa Aluminum Powder K.K.) having a mean particle diameter of 25 micrometers, whereby a heat transfer printing sheet for producing images having metallic luster according to the present invention was obtained.

COMPARATIVE EXAMPLE 1

The procedure of Example 1 was repeated except that the ink compositions for forming the transparent coloring layer and the metallic ink layer used in Example 1 were replaced by the following ink compositions, whereby a comparative heat transfer printing sheet for producing images having metallic luster was obtained.

<Ink Composition for Forming Transparent Coloring Layer>

"Hakurinisu 45" (manufactured by Showa Ink Kogyosho K.K., methylmethacrylate varnish)

<Ink Composition for Forming Metallic Ink Layer>

| | |
|---|---|
| Aluminum paste (manufactured by Showa Aluminum Powder K.K., mean particle diameter = 6 micrometers) | 30.0 parts |
| "Vylon 200" (manufactured by Toyobo Co., Ltd., polyester) | 10.0 parts |
| "Seika Fast Yellow 2270" (manufactured by Dainichiseika Color & Chemicals Mfg. Co., Ltd.) | 7.0 parts |
| "Fuji Red 745 S" (manufactured by Fuji Pigment Co., Ltd.) | 7.0 parts |
| MEK | 36.0 parts |
| Toluene | 36.0 parts |

COMPARATIVE EXAMPLE 2

The procedure of Comparative Example 1 was repeated except that the aluminum paste used in Comparative Example 1 was replaced by an aluminun paste (manufactured by Showa Aluminum Powder K.K.) having a mean particle diameter of 13 micrometers, whereby a comparative heat transfer printing sheet for producing images having metallic luster was obtained.

COMPARATIVE EXAMPLE 3

The procedure of Comparative Example 1 was repeated except that the aluminum paste used in Comparative Example 1 was replaced by an aluminun paste (manufactured by Showa Aluminum Powder K.K.) having a mean particle diameter of 25 micrometers, whereby a comparative heat transfer printing sheet for producing images having metallic luster was obtained.

EXAMPLE 4

The procedure of Example 1 was repeated except that before the transparent coloring layer was formed, 0.3 g/m$^2$ (dry basis) of the following ink composition was coated onto the surface of the substrate sheet by a bar coater and dried at 85° C. to form a releasing layer between the substrate sheet and the transparent coloring layer, whereby a heat transfer printing sheet for producing images having metallic luster according to the present invention was obtained.

<Ink Composition for Forming Releasing Layer>

| | |
|---|---|
| Carnauba wax emulsion ("WE-95" manufactured by Konishi Chemical Ind. Co., Ltd.) | 9.5 parts |
| NBR latex ("JSR 0910" manufactured by Japan Synthetic Rubber Co., Ltd.) | 0.5 parts |

EXAMPLE 5

The procedure of Example 4 was repeated except that the aluminum paste used in Example 4 was replaced by an aluminun paste (manufactured by Showa Aluminum Powder K.K.) having a mean particle diameter of 13 micrometers, whereby a heat transfer printing sheet for producing images having metallic luster according to the present invention was obtained.

EXAMPLE 6

The procedure of Example 1 was repeated except that the aluminum paste used in Example 1 was replaced by silver powder having a mean particle diameter of 3 micrometers, whereby a heat transfer printing sheet for producing images having metallic luster according to the present invention was obtained.

EXAMPLE 7

The procedure of Example 4 was repeated except that the aluminum paste used in Example 4 was replaced by silver powder having a mean particle diameter of 3 micrometers, whereby a heat transfer printing sheet for producing images having metallic luster according to the present invention was obtained.

EXAMPLE 8

The procedure of Example 4 was repeated except that the ink composition for forming a transparent coloring layer used in Example 4 was replaced by the following ink composition, whereby a heat transfer printing sheet for producing images having metallic luster according to the present invention was obtained.

<ink Composition for Forming Transparent Coloring Layer>

"Hakurinisu 45" (manufactured by Showa Ink Kogyosho K.K.)

Phthalocyanine blue

An image was printed by a printer "BC 8" manufactured by Autonics Corp., using each of the heat transfer printing sheets for producing images having metallic luster obtained in Examples 1 to 8 and Comparative Examples 1 to 3. The brightness of the image obtained, transfer printing sensivity, and the hiding power of the image were evaluated. The results are shown in Table 1.

TABLE 1

| | Brightness | Transfer Printing Sensitivity | Hiding Power | Color |
|---|---|---|---|---|
| Example 1 | ○ | ○ | ⊙ | gold |
| Example 2 | ⊙ | ○ | ○ | gold |
| Example 3 | ⊙ | ○ | X | gold |
| Comp. Ex. 1 | X | ○ | ⊙ | gold |
| Comp. Ex. 2 | Δ | ○ | ○ | gold |
| Comp. Ex. 3 | Δ | ○ | X | gold |
| Example 4 | ○ | ⊙ | ⊙ | gold |
| Example 5 | ⊙ | ⊙ | ○ | gold |
| Example 6 | ○ | ○ | ⊙ | gold |
| Example 7 | ○ | ⊙ | ⊙ | gold |
| Example 8 | ○ | ⊙ | ⊙ | blue |

Evaluation Standards (1) Brightness: The brightness of the image printed was visually observed.

⊙: The image has excellent metallic luster.

○: The image has good metallic luster.

Δ: The image has poor metallic luster.

×: The image has almost no metallic luster.

(2) Transfer printing sensitivity: The transfer printing sensitivity was evaluated by printing a thin line image.

⊙: The thin line is accurately reproduced even with low energy.

○: High energy is required to accurately reproduce the thin line.

(3) Hiding power: The hiding power of the image printed was visually observed.

⊙: The ground is completely hidden by the image.

○: Practically acceptable, although the ground can be partially seen through the image.

×: The ground can be seen through the image.

According to the present invention, the transparent coloring layer comprising a coloring agent, and the metallic ink layer comprising a metallic pigment are provided separately as described above. Therefore, the coloring agent and the metallic pigment are free from separation which tends to impair the brightness of a printed image. A colored image having metallic luster can thus be easily obtained. Further, the metallic ink layer can be provided by using an ink which is similar to a printing ink. Therefore, no specific apparatus such as a sputtering apparatus is needed to form the metallic ink layer. Furthermore, the ink has adhesive property in itself, so that it is not necessary to provide an adhesive layer which is needed when a metal-deposited layer is provided.

What is claimed is:

1. A heat transfer printing sheet for producing images having metallic luster, comprising:

a substrate sheet;

a transparent coloring layer comprising a coloring agent and a hot-melt binder, provided at least on one surface of the substrate sheet; and a metallic ink layer provided on the transparent coloring layer comprising aluminum particles each having a diameter ranging from 1 to 20 micrometers, and a hot-melt binder comprising a polyester resin.

2. The heat transfer printing sheet of claim 1, further comprising a releasing layer disposed between the substrate sheet and the transparent coloring layer.

3. The printing sheet of claim 1, wherein the transparent coloring layer has a maximum thickness of 3 micrometers.

4. The printing sheet of claim 1, wherein the metallic ink layer has a thickness ranging from 0.1 to 3 micrometers.

* * * * *